US011173704B2

(12) United States Patent
Abe

(10) Patent No.: US 11,173,704 B2
(45) Date of Patent: Nov. 16, 2021

(54) APPARATUS FOR DISCHARGING LIQUID, PRINTING METHOD, AND STORAGE MEDIUM

(71) Applicant: Kimito Abe, Kanagawa (JP)

(72) Inventor: Kimito Abe, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 3 days.

(21) Appl. No.: 16/814,589

(22) Filed: Mar. 10, 2020

(65) Prior Publication Data

US 2020/0290343 A1 Sep. 17, 2020

(30) Foreign Application Priority Data

Mar. 16, 2019 (JP) ..... JP2019-049225

(51) Int. Cl.
*B41J 2/045* (2006.01)

(52) U.S. Cl.
CPC ..... *B41J 2/04505* (2013.01); *B41J 2/04586* (2013.01)

(58) Field of Classification Search
CPC ..... B41J 2/04505; B41J 2/04586; B41J 2002/1655; B41J 2/16517; B41J 2/04503; B41J 2/04506; B41J 2/04508; B41J 2/0451; B41J 2/04513; B41J 2/04515; B41J 2/0452; B41J 2/04525; B41J 2/04526; B41J 2/04528; B41J 2/04531; B41J 2/04535; B41J 2/04536; B41J 2/04538; B41J 2/0454; B41J 2/04545; B41J 2/04548; B41J 2/04551; B41J 2/04568; B41J 2/04553; B41J 2/04558; B41J 2/0456; B41J 2/04563; B41J 2/04565; B41J 2/04566; B41J 2/04571
See application file for complete search history.

(56) References Cited

U.S. PATENT DOCUMENTS

2010/0182366 A1 7/2010 Takagi et al.
2017/0157921 A1 6/2017 Tashiro et al.
2019/0061339 A1 2/2019 Tashiro et al.

FOREIGN PATENT DOCUMENTS

JP 2010-260338 11/2010

*Primary Examiner* — Kristal Feggins
(74) *Attorney, Agent, or Firm* — Duft & Bornsen, PC

(57) ABSTRACT

An apparatus for discharging liquid includes at least three heads and control circuitry. The at least three heads are configured to discharge liquid and arranged at positions shifted in a second direction intersecting with a first direction. The control circuitry is configured to cause the at least three heads to scan in the first direction a number of times corresponding to an integral multiple of a number of the at least three heads to complete an image in a predetermined area.

18 Claims, 14 Drawing Sheets

FIG. 7

| | | | | | | | |
|---|---|---|---|---|---|---|---|
| 8 | 4 | 8 | 4 | 8 | 4 | 8 | 4 |
| 3 | 7 | 3 | 7 | 3 | 7 | 3 | 7 |
| 6 | 2 | 6 | 2 | 6 | 2 | 6 | 2 |
| 1 | 5 | 9 | 5 | 1 | 5 | 9 | 5 |
| 8 | 4 | 8 | 4 | 8 | 4 | 8 | 4 |
| 3 | 7 | 3 | 7 | 3 | 7 | 3 | 7 |
| 6 | 2 | 6 | 2 | 6 | 2 | 6 | 2 |
| 9 | 5 | 1 | 5 | 9 | 5 | 1 | 5 |
| 8 | 4 | 8 | 4 | 8 | 4 | 8 | 4 |
| 3 | 7 | 3 | 7 | 3 | 7 | 3 | 7 |
| 6 | 2 | 6 | 2 | 6 | 2 | 6 | 2 |
| 1 | 5 | 9 | 5 | 1 | 5 | 9 | 5 |
| 8 | 4 | 8 | 4 | 8 | 4 | 8 | 4 |
| 3 | 7 | 3 | 7 | 3 | 7 | 3 | 7 |
| 6 | 2 | 6 | 2 | 6 | 2 | 6 | 2 |
| 9 | 5 | 1 | 5 | 9 | 5 | 1 | 5 |

H1
H2
H3

UPSTREAM SIDE

CENTER

DOWNSTREAM SIDE

UPSTREAM SIDE

CENTER

DOWNSTREAM SIDE

FIG. 13

| | | | | | | | | | | | |
|---|---|---|---|---|---|---|---|---|---|---|---|
| 16 | 8 | 16 | 8 | 16 | 8 | 16 | 8 | 16 | 8 | 16 | 8 |
| 7 | 15 | 7 | 15 | 7 | 15 | 7 | 15 | 7 | 15 | 7 | 15 |
| 14 | 6 | 14 | 6 | 14 | 6 | 14 | 6 | 14 | 6 | 14 | 6 |
| 5 | 13 | 5 | 13 | 5 | 13 | 5 | 13 | 5 | 13 | 5 | 13 |
| 12 | 4 | 12 | 4 | 12 | 4 | 12 | 4 | 12 | 4 | 12 | 4 |
| 3 | 11 | 3 | 11 | 3 | 11 | 3 | 11 | 3 | 11 | 3 | 11 |
| 10 | 2 | 10 | 18 | 10 | 2 | 10 | 18 | 10 | 2 | 10 | 18 |
| 1 | 9 | 17 | 9 | 1 | 9 | 17 | 9 | 1 | 9 | 17 | 9 |
| 16 | 8 | 16 | 8 | 16 | 8 | 16 | 8 | 16 | 8 | 16 | 8 |
| 7 | 15 | 7 | 15 | 7 | 15 | 7 | 15 | 7 | 15 | 7 | 15 |
| 14 | 6 | 14 | 6 | 14 | 6 | 14 | 6 | 14 | 6 | 14 | 6 |
| 5 | 13 | 5 | 13 | 5 | 13 | 5 | 13 | 5 | 13 | 5 | 13 |
| 12 | 4 | 12 | 4 | 12 | 4 | 12 | 4 | 12 | 4 | 12 | 4 |
| 3 | 11 | 3 | 11 | 3 | 11 | 3 | 11 | 3 | 11 | 3 | 11 |
| 10 | 2 | 10 | 18 | 10 | 2 | 10 | 18 | 10 | 2 | 10 | 18 |
| 1 | 9 | 17 | 9 | 1 | 9 | 17 | 9 | 1 | 9 | 17 | 9 |
| 16 | 8 | 16 | 8 | 16 | 8 | 16 | 8 | 16 | 8 | 16 | 8 |
| 7 | 15 | 7 | 15 | 7 | 15 | 7 | 15 | 7 | 15 | 7 | 15 |
| 14 | 6 | 14 | 6 | 14 | 6 | 14 | 6 | 14 | 6 | 14 | 6 |
| 5 | 13 | 5 | 13 | 5 | 13 | 5 | 13 | 5 | 13 | 5 | 13 |
| 12 | 4 | 12 | 4 | 12 | 4 | 12 | 4 | 12 | 4 | 12 | 4 |
| 3 | 11 | 3 | 11 | 3 | 11 | 3 | 11 | 3 | 11 | 3 | 11 |
| 10 | 2 | 10 | 18 | 10 | 2 | 10 | 18 | 10 | 2 | 10 | 18 |
| 1 | 9 | 17 | 9 | 1 | 9 | 17 | 9 | 1 | 9 | 17 | 9 |
| 16 | 8 | 16 | 8 | 16 | 8 | 16 | 8 | 16 | 8 | 16 | 8 |
| 7 | 15 | 7 | 15 | 7 | 15 | 7 | 15 | 7 | 15 | 7 | 15 |
| 14 | 6 | 14 | 6 | 14 | 6 | 14 | 6 | 14 | 6 | 14 | 6 |
| 5 | 13 | 5 | 13 | 5 | 13 | 5 | 13 | 5 | 13 | 5 | 13 |
| 12 | 4 | 12 | 4 | 12 | 4 | 12 | 4 | 12 | 4 | 12 | 4 |
| 3 | 11 | 3 | 11 | 3 | 11 | 3 | 11 | 3 | 11 | 3 | 11 |
| 10 | 18 | 10 | 2 | 10 | 18 | 10 | 2 | 10 | 18 | 10 | 2 |
| 17 | 9 | 1 | 9 | 17 | 9 | 1 | 9 | 17 | 9 | 1 | 9 |

H1

H2

H3

FIG. 14

| MODE | RESOLUTION | NUMBER OF SCAN NUMBER OF PASS /NUMBER OF INTERLACE | OVERLAP PROCESSING |
|---|---|---|---|
| MODE 1 | 600 × 450 | 6 SCANS 2/3 | NOT EXECUTED |
| MODE 2 | 600 × 600 | 9 SCANS 2/4+1 | EXECUTED |
| MODE 3 | 600 × 900 | 12 SCANS 2/6 | NOT EXECUTED |
| MODE 4 | 600 × 1200 | 18 SCANS 2/8+2 | EXECUTED |
| MODE 5 | 1200 × 1200 | 32 SCANS 4/8 | NOT EXECUTED |

APPARATUS FOR DISCHARGING LIQUID, PRINTING METHOD, AND STORAGE MEDIUM

CROSS-REFERENCE TO RELATED APPLICATION

This patent application is based on and claims priority pursuant to 35 U.S.C. § 119(a) to Japanese Patent Application No. 2019-049225, filed on Mar. 16, 2019, in the Japan Patent Office, the entire disclosure of which is hereby incorporated by reference herein.

BACKGROUND

Technical Field

Aspects of the present disclosure relate to an apparatus for discharging liquid, a printing method, and a storage medium.

Related Art

A plurality of heads for discharging liquids are shifted and connected in the sub-scanning direction so that some nozzles of each joint portion are overlapped with each other in the sub-scanning direction. Dots in one scan are selectively discharged by overlapped nozzles to obscure the joint portion.

SUMMARY

In an aspect of the present disclosure, there is provided an apparatus for discharging liquid includes at least three heads and control circuitry. The at least three heads are configured to discharge liquid and arranged at positions shifted in a second direction intersecting with a first direction. The control circuitry is configured to cause the at least three heads to scan in the first direction a number of times corresponding to an integral multiple of a number of the at least three heads to complete an image in a predetermined area.

In another aspect of the present disclosure, there is provided a printing method for an apparatus including at least three heads configured to discharge liquid and arranged at positions shifted in a second direction intersecting with a first direction. The method includes scanning the at least three heads in the first direction a number of times corresponding to an integral multiple of a number of the at least three heads to complete an image in a predetermined area.

In another aspect of the present disclosure, there is provided a non-transitory storage medium storing computer readable code for causing an apparatus including at least three heads configured to discharge liquid and arranged at positions shifted in a second direction intersecting with a first direction, to execute a process. The process includes scanning the at least three heads in the first direction a number of times corresponding to an integral multiple of a number of the at least three heads to complete an image in a predetermined area.

BRIEF DESCRIPTION OF THE DRAWINGS

A more complete appreciation of the disclosure and many of the attendant advantages and features thereof can be readily obtained and understood from the following detailed description with reference to the accompanying drawings, wherein:

FIG. 7 is an illustration of an example of assignment of heads and scans to dots in one band (predetermined area);

FIG. 13 is an illustration of an example of assignment of heads and scans to dots in one band (predetermined area); and FIG. 14 is a table illustrating an example of the relationship between mode and overlap processing in a third embodiment of the present disclosure.

Figure 1:
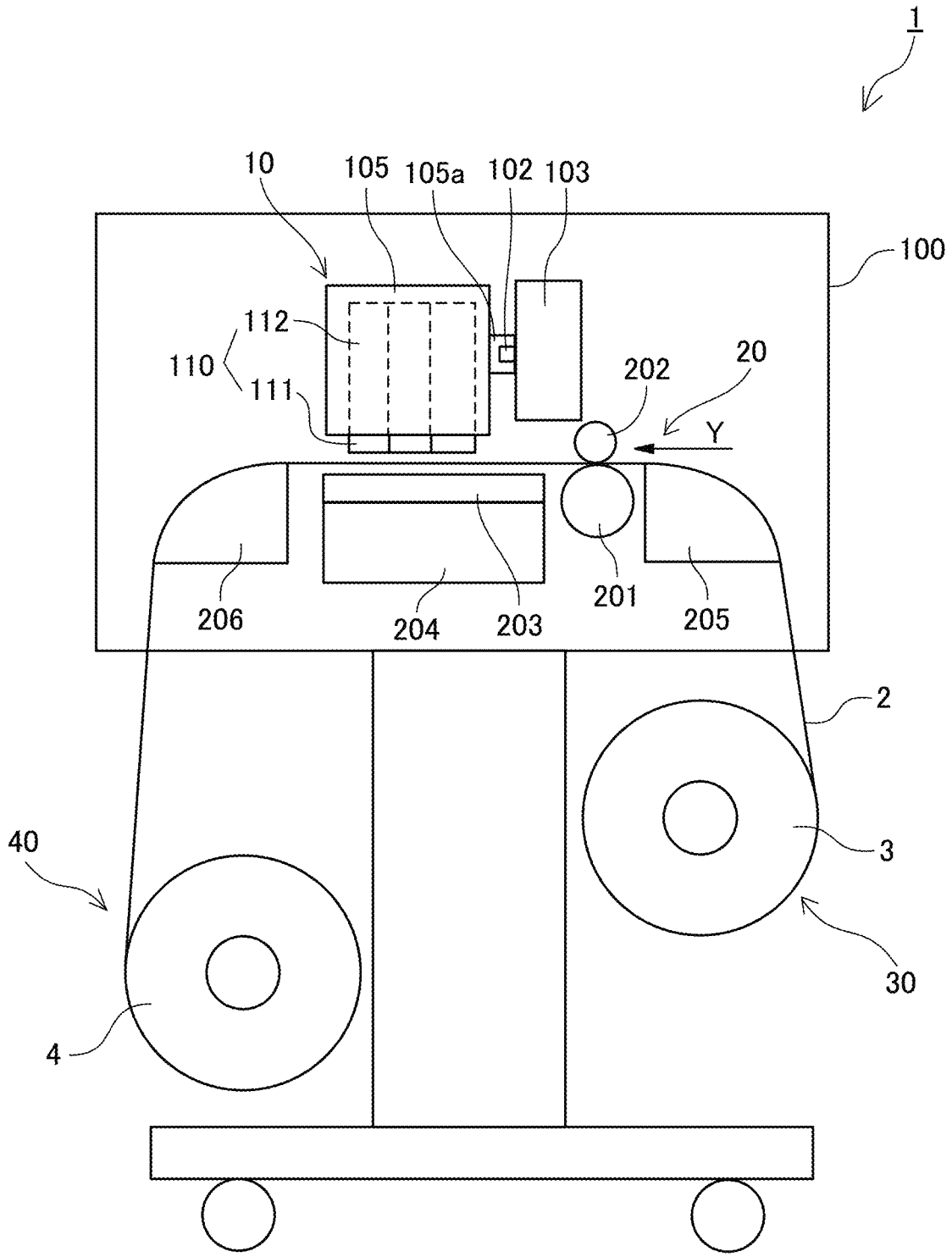
FIG. 1 is a side view of a mechanical section of a printing apparatus as an apparatus for discharging liquid according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present disclosure. As used herein, the singular forms "a", "an" and "the" are intended to include the plural forms as well, unless the context clearly indicates otherwise.

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Figure 2:
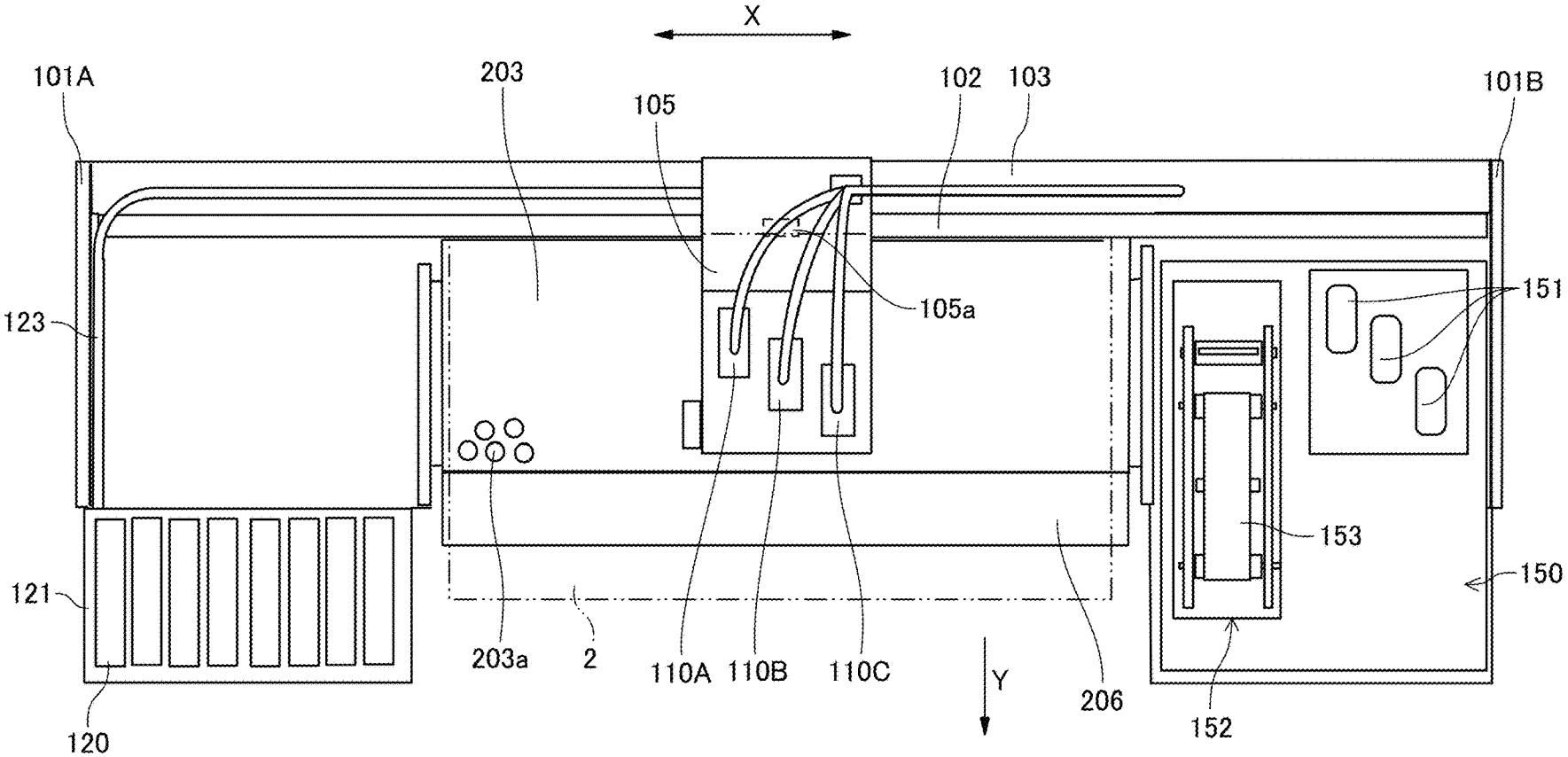
FIG. 2 is a plan view of the mechanical section of the printing apparatus illustrated in FIG. 1.
Figure 3:
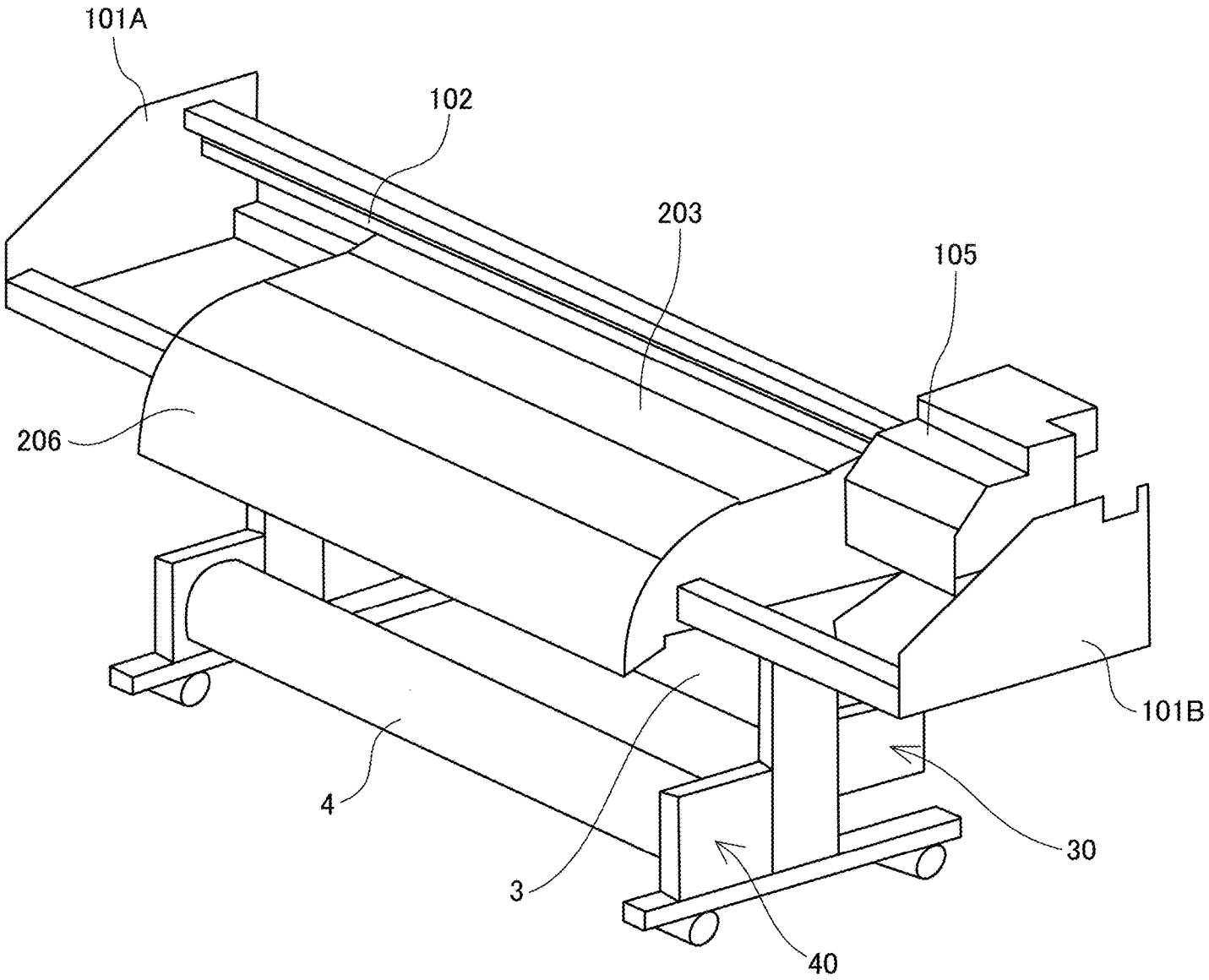
FIG. 3 is a perspective view of the mechanical section of the printing apparatus illustrated in FIG. 1.
Figure 4:
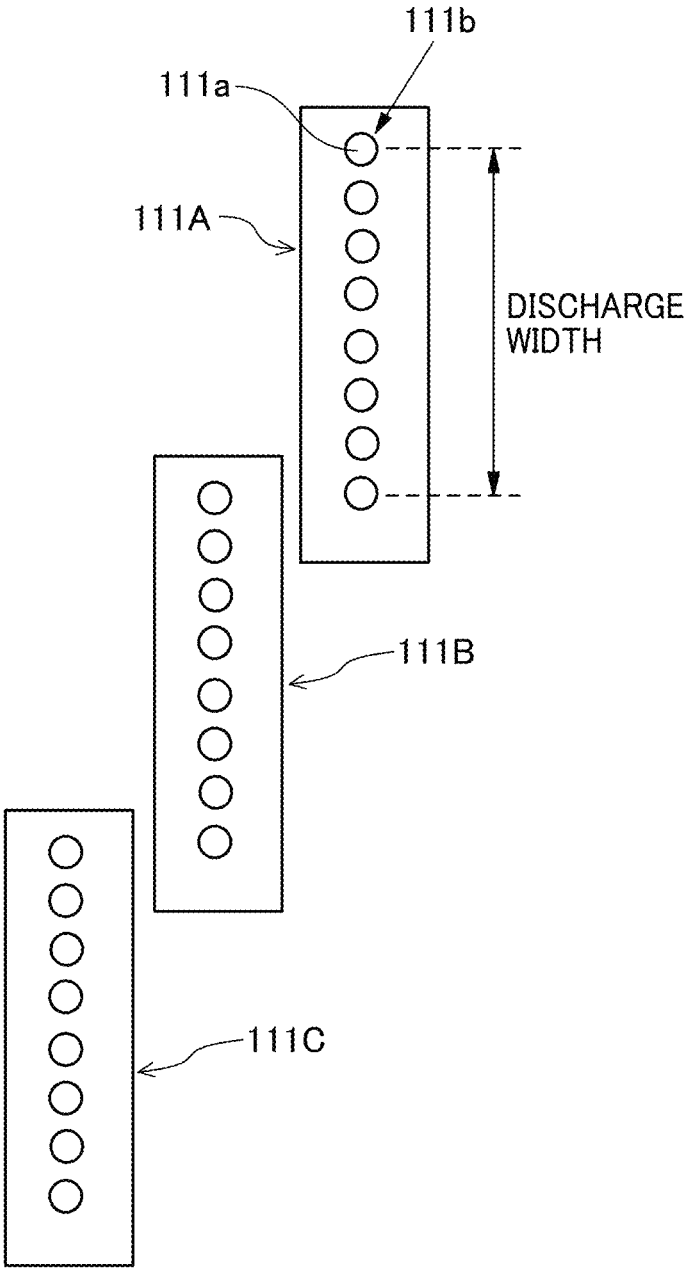
FIG. 4 is a plan view of heads in the printing apparatus of FIG. 1.

Referring now to the drawings, wherein like reference numerals designate identical or corresponding parts throughout the several views, embodiments of the present disclosure are described below. An example of a printing apparatus as an apparatus for discharging liquid according to an embodiment of the present disclosure is described with reference to FIGS. 1 to 4. FIG. 1 is a side view of a mechanical section of the printing apparatus according to the present embodiment. FIG. 2 is a plan view of the mechanical section of the printing apparatus of FIG. 1. FIG. 3 is a perspective view of a main part of the printing apparatus of FIG. 1. FIG. 4 is a plan view of heads.

The printing apparatus 1 is a serial-type inkjet recording apparatus as the apparatus for discharging a liquid according to the present embodiment. The printing apparatus 1 includes a printing section 10 and a conveyance section 20 in the apparatus body 100. The printing section 10 performs printing on a sheet material 2 such as roll paper. The conveyance section 20 conveys the sheet material 2. The printing apparatus 1 further includes a roll holding unit 30 and a roll take-up unit 40 outside the apparatus body 100. The roll holding unit 30 holds a supply roll 3 in which the sheet material 2 is wound in a roll shape. The roll take-up unit 40 holds a take-up roll 4 in which the sheet material 2 is taken up.

The printing section 10 holds and guides a carriage 105, which is a moving body, with a guide 102 attached to a stay 103 extending between a left side plate 101A and a right side plate 101B so that the carriage 105 can reciprocate in a main scanning direction (indicated by arrow X) as a first direction. A fitting portion 105*a* is disposed on the back of the carriage 105 to movably fit to the guide 102.

In the present embodiment, three liquid discharge units 110A, 110B, and 110C (collectively referred to as liquid discharge units 110 unless distinguished) are mounted on the carriage 105. Each of the liquid discharge units 110 includes a liquid discharge head 111 as a liquid discharger and a sub tank 112 to supply liquid to the head 111. The liquid discharge head 111 (simply referred to as "head 111") and the sub tank 112 are molded as a single unit. As illustrated in FIG. 4, each head 111 has a nozzle row 111*b* in which a plurality of nozzles 111*a* for discharging liquid are arranged. The width of the nozzle row 111*b* is defined as a discharge width (nozzle row width).

Thus, the three heads 111 are arranged at positions shifted from each other in a conveyance direction (sub-scanning direction) of the sheet material 2 that is a second direction intersecting the main scanning direction as the first direction. A part of the nozzles 111*a* in one head 111 overlaps with a part of the nozzles 111*a* in another head 111 at a joint portion between the heads 111.

A cartridge holder 121 is disposed on one end of the apparatus body 100. A plurality of main tanks (liquid cartridges) 120 to contain liquids of colors are replaceably mounted in the cartridge holder 121. Liquid of each color is supplied from the main tank 120 mounted on the cartridge holder 121 to the head 111 of each liquid discharge unit 110 via a supply tube 123 for each color by e.g., a liquid supply pump.

The conveyance section 20 includes a conveyance roller 201 and an opposite roller 202 as a conveyor disposed upstream from the printing section 10 in the conveyance direction of the sheet material 2 (sub-scanning direction indicated by arrow Yin FIG. 2). The conveyance roller 201 and the opposite roller 202 nip and convey the sheet material 2.

The conveyance section 20 includes a platen member 203 facing the head 111 and a suction device 204 to attract the sheet material 2 by suction through suction holes 203*a* of the platen member 203. Note that, although the suction holes 203*a* are partially illustrated in FIG. 2, the suction holes 203*a* are disposed on the entire platen member 203.

A conveyance guide 205 is disposed on an entrance side of the conveyance section 20 to guide the sheet material 2 supplied from the supply roll 3. A conveyance guide 206 is disposed on an exit side of the conveyance section 20 to guide the sheet material 2 to the take-up roll 4.

A maintenance-and-recovery device 150 to perform maintenance and recovery of the heads 111 is disposed on one end in the main scanning direction of the carriage 105.

The maintenance-and-recovery device 150 includes, for example, caps 151 to cap nozzle surfaces of the heads 111 and a wiping unit 152 including a web 153 to wipe the nozzle surfaces.

In the printing apparatus 1, the sheet material 2 is conveyed in the conveyance direction by the conveyance roller 201 and the opposite roller 202 while being attracted on the platen member 203 by the suction of the suction device 204.

Therefore, for example, in single-pass printing, the heads 111 are driven according to print signals while the carriage 105 is moved in the main scanning direction so that liquid of a color(s) is discharged to the stopped sheet material 2 to print one line. After the sheet material 2 is fed by a predetermined amount, the next line is printed. The process is repeated until printing ends, and then the sheet material 2 is ejected. In multi-pass printing, scanning of the carriage 105 and conveyance of the sheet material 2 are repeated a plurality of times to print one line.

Next, an example of a control unit of the printing apparatus is described with reference to a block diagram of FIG. 5.

Figure 5:
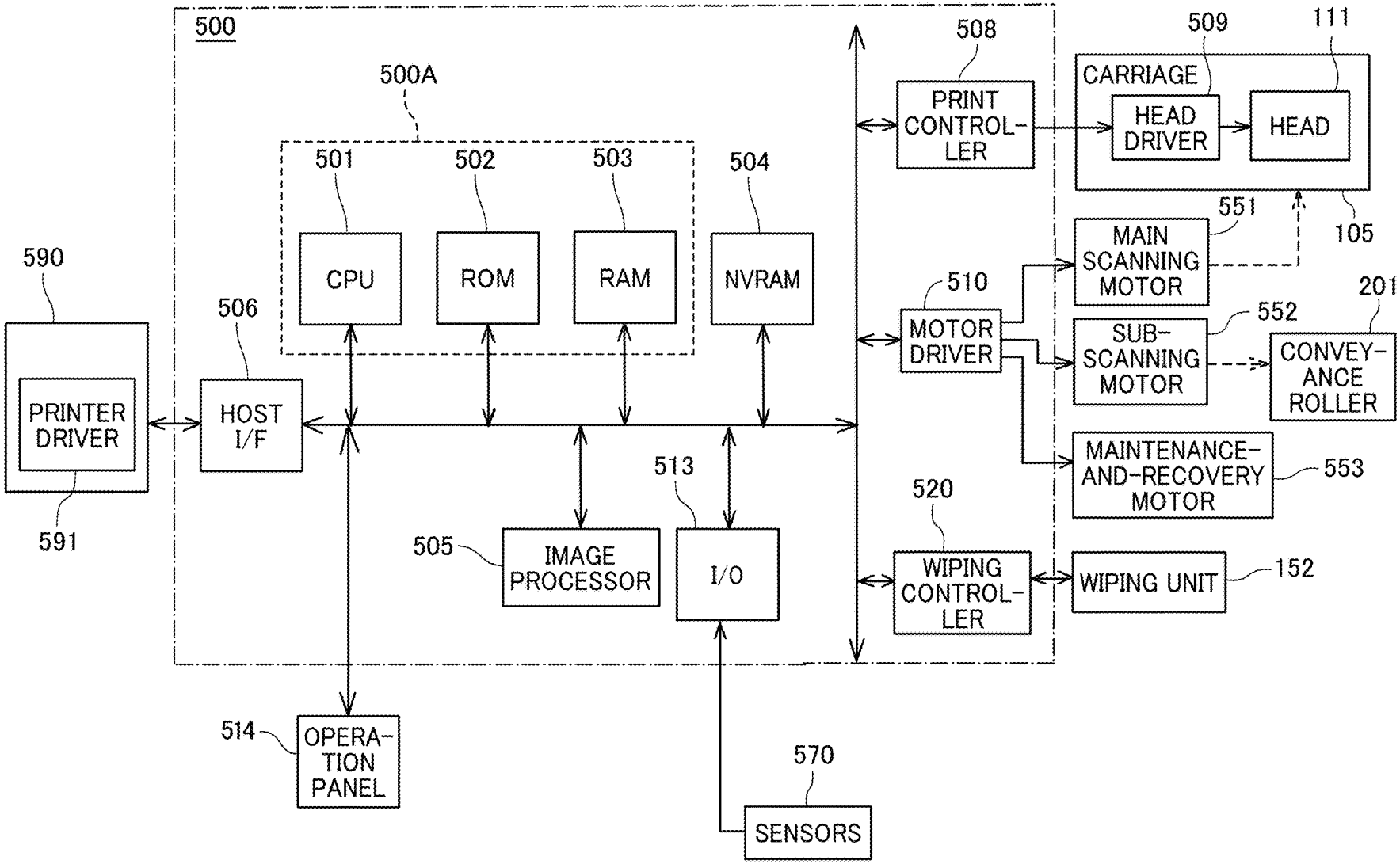
FIG. 5 is a block diagram of a control unit in the printing apparatus of FIG. 1.

A control unit 500 illustrated in FIG. 5 includes a main control unit 500A including a central processing unit (CPU) 501, a read only memory (ROM) 502, and a random-access memory (RAM) 503. The CPU 501 performs an entire control of the printing apparatus 1. The ROM 502 stores programs including a program in an embodiment of the present disclosure to be executed by the CPU 501. The RAM 503 temporarily stores image data or the like.

The control unit 500 further includes a rewritable non-volatile random access memory (NVRAM) 504 and an image processor 505. The NVRAM 504 can maintain data even when the apparatus is powered off. The image processor 505 performs various signal processing on image data, image processing such as rearrangement, and input and output signal processing for controlling the entire printing apparatus 1.

The control unit 500 further includes a print controller 508 and a head driver (driver integrated circuit (IC)) 509. The print controller 508 includes a data transmitter to control driving of the heads 111 and a drive signal generator. The head driver 509 drives the heads 111 mounted on the carriage 105.

The control unit 500 further includes a motor driver 510 to drive a main scanning motor 551, a sub-scanning motor 552, and a maintenance-and-recovery motor 553. The main scanning motor 551 moves the carriage 105 for scanning. The sub-scanning motor 552 drives the conveyance roller 201. The maintenance-and-recovery motor 553 moves (elevates up and down) the caps 151 of the maintenance-and-recovery device 150 and drives a suction unit.

Further, the control unit 500 includes a wiping controller 520 to drive the wiping unit 152.

The control unit 500 includes an input-and-output (I/O) unit 513. The I/O unit 513 acquires information from a temperature sensor and other various sensor groups 570 mounted on the printing apparatus 1, extracts information necessary for controlling the printing apparatus 1, and uses the extracted information for various controls.

The control unit 500 is connected to an operation panel 514 to input and display information for the printing apparatus 1.

The control unit 500 further includes an interface (I/F) 506 to transmit and receive data or signals to and from a host 590, such as an information processing device (e.g., personal computer), an image reader, and an imaging device. The I/F 506 receives information from a printer driver 591 of the host 590 via a cable or network.

The CPU 501 of the control unit 500 reads and analyzes print data stored in a reception buffer of the I/F 506, performs desired image processing, data sorting, or other processing with the image processor 505, and transfers image data from the print controller 508 to the head driver 509.

The print controller 508 transfers the image data to the head driver 509 as serial data, while outputting a transfer clock, latch signal, and control signal, which are necessary for transferring the image data and confirming the transfer, to the head driver 509.

The print controller 508 includes a driving signal generator that includes a digital to analog (D/A) converter, a voltage amplifier, and a current amplifier. The D/A converter executes a digital-to-analog conversion of pattern data of a driving pulse stored in the ROM 502. The print controller 508 generates a drive waveform consisting of a single drive pulse or multiple drive pulses and outputs the drive waveform to the head driver 509.

In accordance with serially-input image data corresponding to one line recorded by the heads 111, the head driver 509 selects driving pulses of a driving waveform transmitted from the print controller 508 and applies the selected driving pulses to pressure generators to drive the heads 111. Thus, the heads 111 are driven. The head driver 509 selects all or a part of the drive pulses composing the drive waveform or all or a part of wave components composing a drive pulse to selectively discharge different sizes of dots, such as a large droplet, a middle droplet, and a small droplet.

Figure 6:
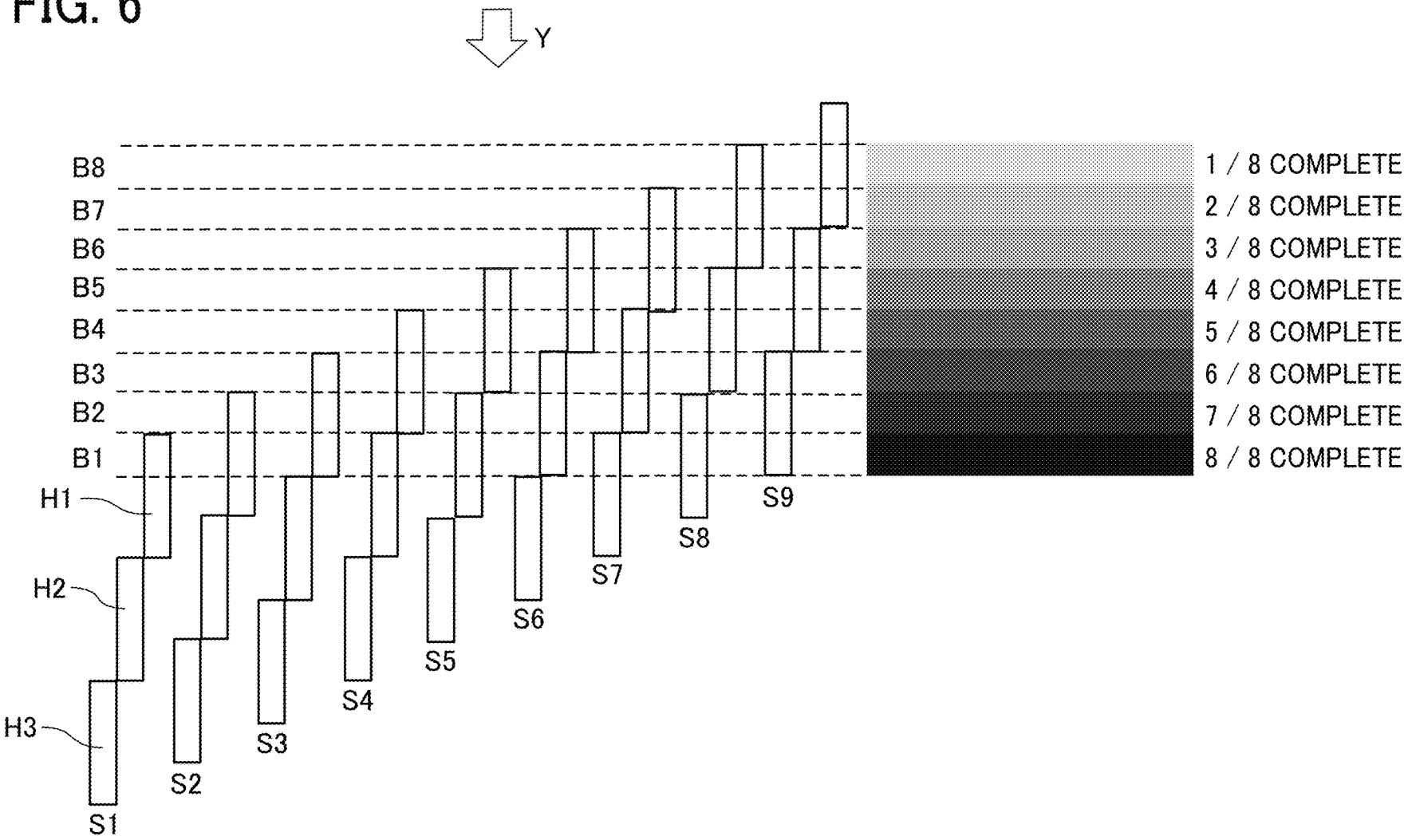
FIG. 6 is an illustration of control of scanning in a first embodiment of the present disclosure.

Next, control of multi-pass printing according to a first embodiment of the present disclosure is described with reference to FIGS. 6 and 7. FIG. 6 is an illustration of control in a case in which printing is performed by the two-pass ¼ interlace plus one scan method in the first embodiment. FIG. 7 is an illustration of an example of assignment of heads and scans to dots in one band (predetermined area). Note that numbers in FIG. 7 indicate scans S1 to S9.

In the present embodiment, the carriage 105 is controlled to perform nine scans to complete an image of a predetermined area (referred to as "band") B (referred to as "band B" unless, e.g., bands B1 to B8 in FIG. 6 distinguished) smaller than the discharge width of the head 111 in the sub-scanning direction Y as the second direction. Hereinafter, the three heads 111A, 111B, and 111C are referred to as heads H1, H2, and H3, respectively.

That is, the carriage 105 is scanned in the first direction a number of times corresponding to an integral multiple of the number of heads 111 (the number of heads) to complete the image of one band B. Thus, the heads 111 and the sheet P are relatively moved so that the joint portion of adjacent two of the heads H1, H2, and H3 is located at the boundary of adjacent two bands B, and printing is performed.

Specifically, in the first scan (scanning) S1 to the third scan S3, dots are formed in the area of the band B1 using the head H1. In the fourth scan S4 to the sixth scan S6, dots are formed in the band B1 area using the head H2. In the seventh scan S7 to the ninth scan S9, dots are formed in the band B1 area using the head H3.

In such a case, the ninth scan is performed so as to overlap the area of the first scan in the two-pass ¼ interlace method. Therefore, one band B is separately discharged by the head H1 in the first scan and the head H3 in the ninth scan. For example, as illustrated in FIG. 7, "9" and "5" and "1" and "5" are assigned to two passes. Therefore, the first scanning line in the two-pass ¼ interlace method is completed in three scans (three passes).

As described above, dots in a predetermined area B in which an image is completed in the first scanning (first scan S1) and the last scanning (ninth scan S9) are separately formed by the head H1 that discharges the liquid in the first scanning and the head H3 that discharges the liquid in the final scanning.

The number of times of use of the heads H1 to H3 for completing the image of the band B1 is all three times in the band B1. The dots of the band B are evenly assigned to the three heads H1 to H3 as illustrated in FIG. 7.

In the present embodiment, dots for eight bands are formed by nine scans corresponding to an integral multiple of the number of heads. The number of bands is smaller than the number of scans that is an integral multiple of the number of heads.

As described above, in the present embodiment, three or more heads 111 to discharge liquid are arranged at the positions shifted from each other in the second direction intersecting the first direction. In the printing method, the heads 111 are scanned in the first direction the number of times of scanning corresponding to an integral multiple of the number of heads 111 to complete an image of a predetermined area (band) smaller than the discharge width of the head 111 in the second direction. The control process is executed by a computer (main control unit 500A) according to the program in the present embodiment of the present disclosure.

Figure 8:
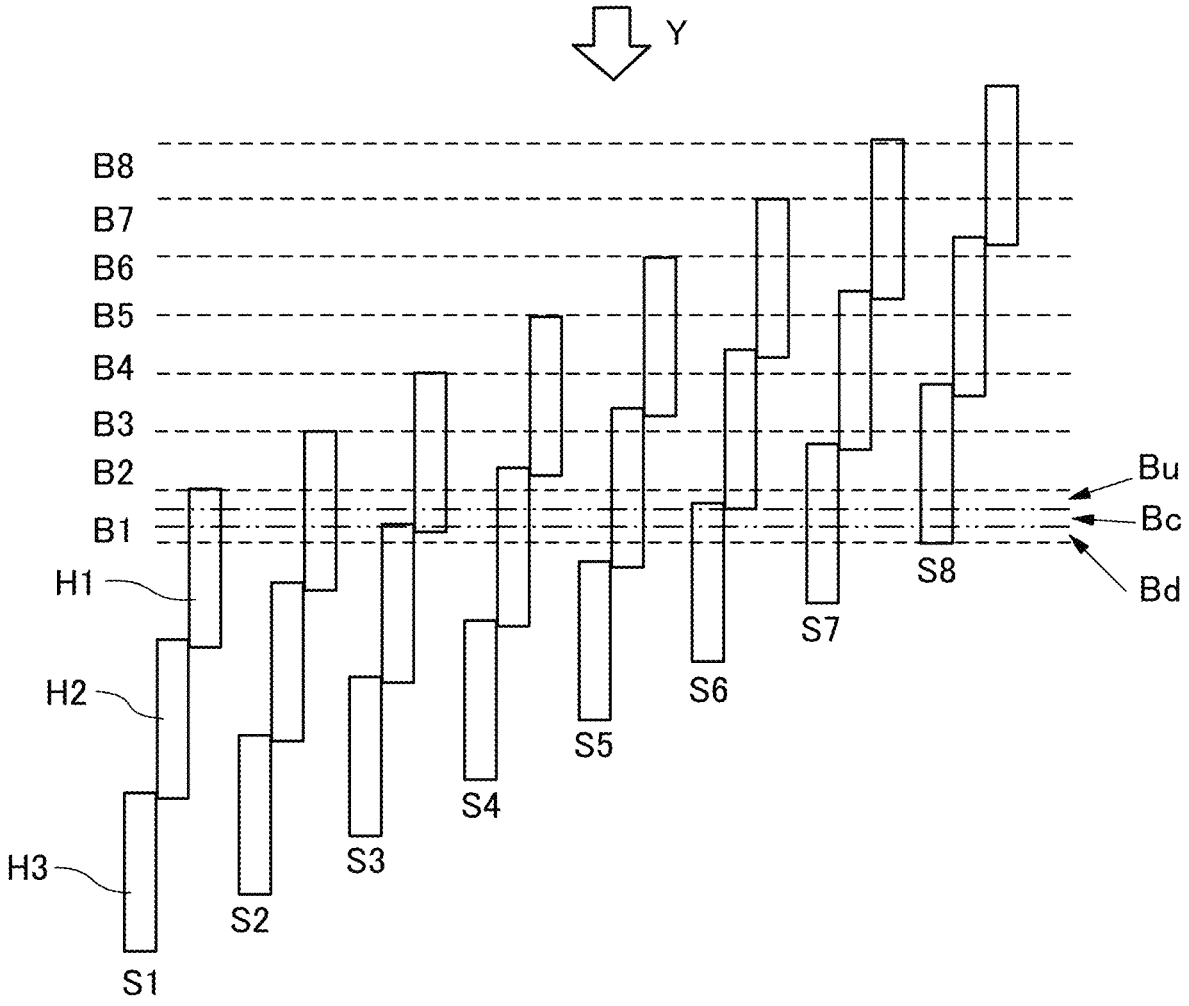
FIG. 8 is an illustration of control of scanning in Comparative Example 1.
Figure 9A:
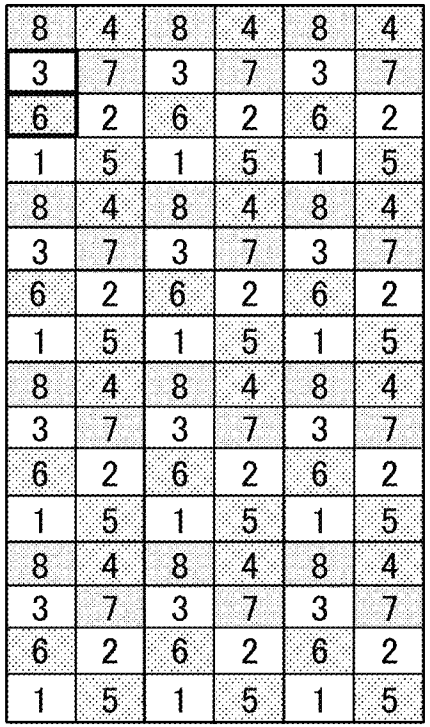
FIGS. 9A to 9C are illustrations of an example of assignment of heads and scans to dots in one band (predetermined area)
Figure 9B:
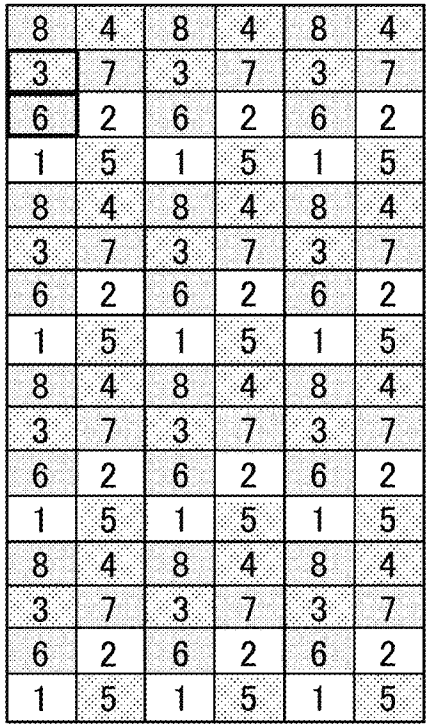
Figure 9C:
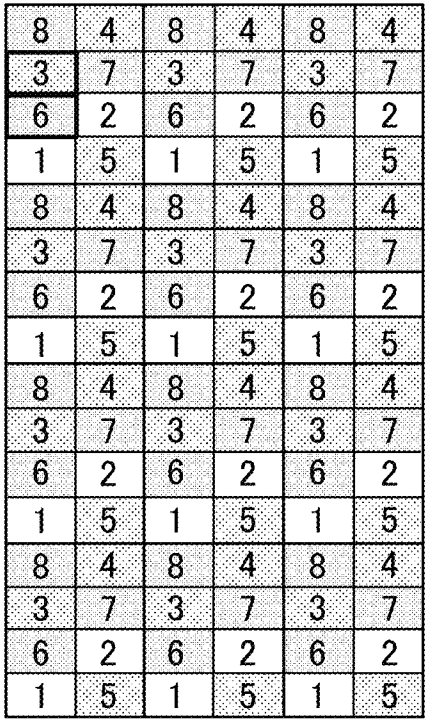

Here, Comparative Example 1 is described with reference to FIGS. 8 and 9A to 9C. FIG. 8 is an illustration of control in the case in which printing is performed by the two-pass ¼ interlace method. FIG. 9 is an illustration of an example of assignment of dots to each head in one band in the two-pass ¼ interlace method.

In Comparative Example 1, since the band B is completed by eight scans, dots are formed in the area of the band B1 using the head H1 in the first scan S1 and the second scan S2. In the third scan S3, dots are formed in the area of the band B1 using the heads H1 and H2. In the fourth scan S4 and the fifth scan S5, dots are formed in the area of the band B1 using the head H2. In the sixth scan S6, dots are formed in the area of the band B1 using the heads H2 and H3. In the seventh scan S7 and the eighth scan S8, dots are formed in the area of the band B1 using the head H3.

As described above, in Comparative Example 1, the number of times of use of the heads H1 to H3 is three times for the head H1, three times for the head H2, and three times for the head H3 in an upper region Bu of the band B. Similarly, in a central region Bc of the band B, the number of times of use of the heads H1 to H3 is three times for the head H1, twice for the head H2, and three times for the head H3. In a lower region Bd of the band B, the number of times of use of the heads H1 to H3 is twice for the head H1, three times for the head H2, three times for the head H3.

In Comparative Example 1, since a joint portion of adjacent rows of the heads H1 to H3 is located in the band B, a difference occurs in a part of the heads 111 used for forming dots in the band B. For example, FIG. 9A illustrates an example of the assignment of dots in the upper region Bu to the heads. FIG. 9B illustrates an example of the assignment of dots in the central region Bc to the heads. FIG. 9C illustrates an example of the assignment of dots in the lower region Bd to the heads.

For example, regarding the dots surrounded by thick lines in FIGS. 9A to 9C, the dots surrounded by the thick line in the upper region Bu illustrated in FIG. 9A are formed by the head H1 in the third scan S3 and the head H2 in the sixth scan S6. On the other hand, the dots surrounded by the thick line in each of the central region Bc illustrated in FIG. 9B and the lower region Bd illustrated in FIG. 9C are formed by the head H2 in the third scan S3 and the head H3 in the sixth scan.

Figure 10A:
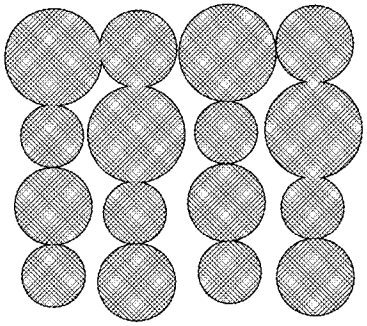
FIGS. 10A to 10C are illustrations of an example of image unevenness in Comparative Example 1.
Figure 10B:
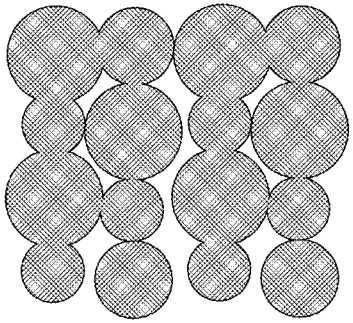
Figure 10C:
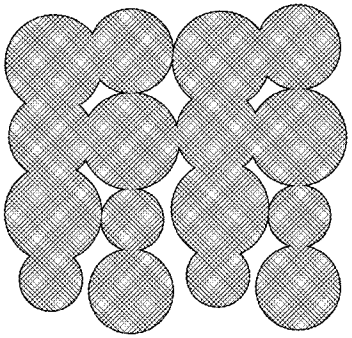
Figure 11A:
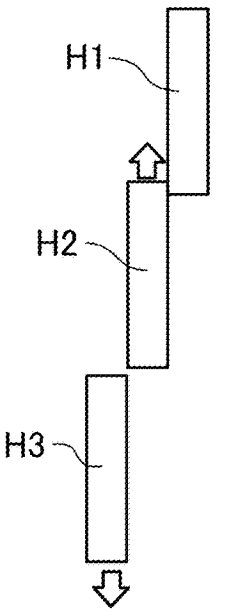
FIGS. 11A to 11D are illustrations of another example of image unevenness in Comparative Example 1.
Figure 11B:
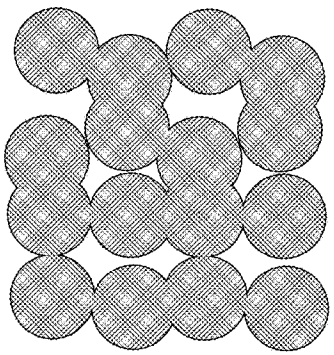
Figure 11C:
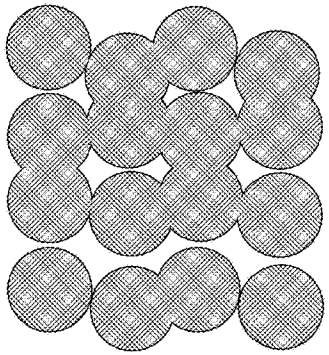
Figure 11D:
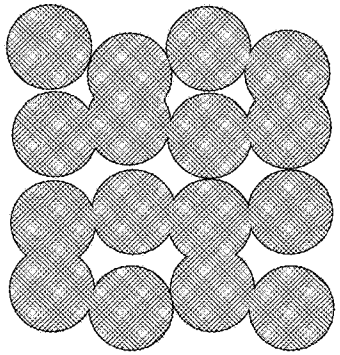

Therefore, when there is a difference in discharge characteristics between the heads H1 to H3, for example, as illustrated in FIG. 10A to FIG. 10C, a difference in coverage occurs due to a difference in dot diameter or a deviation of landing position, thus causing image unevenness. Further, when the mounting positions of the heads H1 to H3 are displaced, for example, when the head H2 is deviated toward the head H1 and the head H3 is mounted away from the head H2 as illustrated in FIG. 11A, deviations of dots as illustrated in FIGS. 1B to 11D may cause white streaks, thus causing image unevenness.

Figure 12:
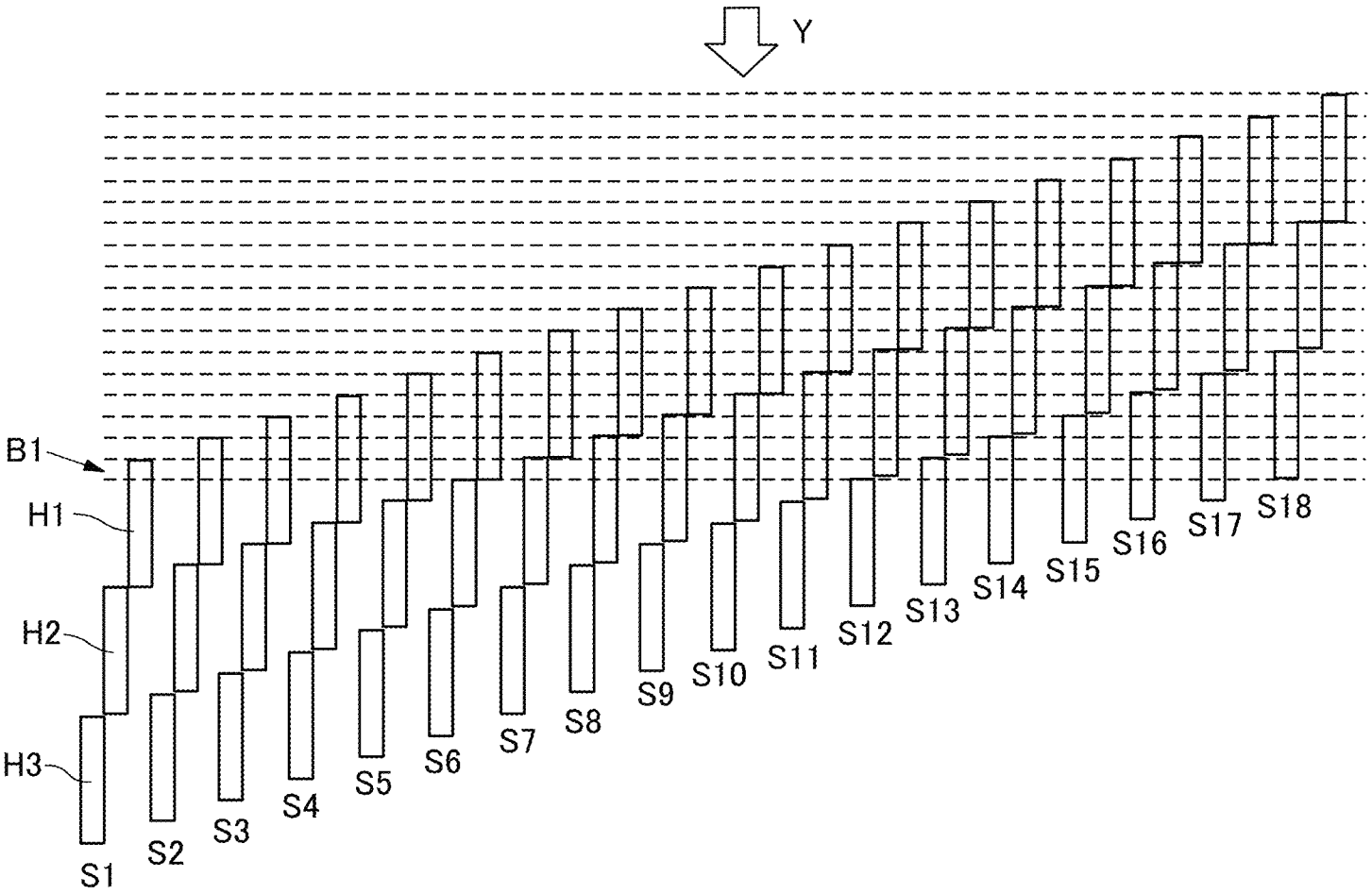
FIG. 12 is an illustration of control of scanning in a second embodiment of the present disclosure.

Next, control of multi-pass printing according to a second embodiment of the present disclosure is described with reference to FIGS. 12 and 13. FIG. 12 is an illustration of control in a case in which printing is performed by the two-pass ⅛ interlace plus one scan method in the second embodiment. FIG. 13 is an illustration of an example of assignment of heads and scans to dots in one band (predetermined area). Note that numbers in FIG. 12 indicate scans S1 to S18.

Also in the present embodiment, an image of one band B is completed by scanning eighteen times that corresponds to an integral multiple of the number of heads 111. Thus, the heads 111 and the sheet P are relatively moved so that the joint portion of adjacent two of the heads H1, H2, and H3 is located at the boundary of adjacent two bands B, and printing is performed.

For example, in the first scan S1 to the sixth scan S6, dots are formed in the area of the band B1 using the head H1. In the seventh scan S7 to the twelfth scan S12, dots are formed in the area of the band B1 using the head H2. In the thirteenth scan S13 to the eighteenth scan S18, dots are formed in the area of the band B1 using the head H3.

The number of times of use of the heads H1 to H3 for completing the image of the band B1 is all six times in the band B1. The entire dots of the band B1 are evenly assigned to the three heads H1 to H3 as illustrated in FIG. 13.

In the present embodiment, since the number of scans is greater by two scans than the two-pass ⅛ interlace method, the first scan and the second scan overlap the seventeenth scan and the eighteenth scan, respectively. Therefore, one band B is separately discharged by the head H1 and the head H3.

Here, half of the dots in each of the first scan and the second scan are thinned out and dots of the seventeenth scan and the eighteenth scan are inserted into the first scan and the second scan, respectively. For example, as illustrated in FIG. 13, "1" and "9" and "17" and "9" and "10" and "2" and "10" and "18" are assigned to two passes. Therefore, the scanning lines in the first scan and the second scan in the two-pass ⅛ interlace method are completed in three scans (three passes).

Next, a third embodiment of the present disclosure is described with reference to FIG. 14. FIG. 14 is a table illustrating an example of the relationship between mode and processing (referred to as overlap processing OLP) according to the present embodiment for making the number of times of scanning an integral multiple of the number of heads.

In the present embodiment, a table including modes 1 to 5 and defining the relationship between each of the modes 1 to 5 and the number of scans is stored in a non-volatile storage unit, such as the NVRAM 504. Scanning is performed by the number of scans set according to a designated mode.

Here, as illustrated in FIG. 14, the overlap processing is performed for the modes 2 and 4. The mode 2 is a mode for implementing the first embodiment. The mode 4 is a mode for implementing the second embodiment.

In the present disclosure, the liquid discharged is not limited to a particular liquid as long as the liquid has a viscosity or surface tension to be discharged from a head (liquid discharge head). However, preferably, the viscosity of the liquid is not greater than 30 mPa·s under ordinary temperature and ordinary pressure or by heating or cooling. More specifically, the liquid to be discharged is a solution, a suspension liquid, an emulsion, or the like containing a solvent such as water or an organic solvent, a colorant such as a dye or a pigment, a function-imparting material such as a polymerizable compound, a resin, or a surfactant, a biocompatible material such as deoxyribonucleic acid (DNA), amino acid, protein, or calcium, or an edible material such as a natural pigment, which can be used, for example, for an inkjet ink, a surface treatment liquid, a liquid for forming a constituent element of an electronic element or a light emitting element or an electronic circuit resist pattern, a three-dimensional modeling material liquid, or the like.

Examples of an energy source for generating energy to discharge liquid include a piezoelectric actuator (a laminated piezoelectric element or a thin-film piezoelectric element), a thermal actuator that employs an electrothermal transducer element, such as a heat element, and an electrostatic actuator including a diaphragm and opposed electrodes.

The term "apparatus for discharging liquid" can also include means relating to feeding, conveying, discharging, which can adhere liquid, pretreatment apparatus, post-processing apparatus, and the like.

The liquid discharge apparatus may be, for example, an image forming apparatus to form an image on a sheet by discharging ink, or a three-dimensional fabricating apparatus (solid-object fabricating apparatus) to discharge a fabrication liquid to a powder layer in which powder material is formed in layers, so as to form a three-dimensional fabrication object (solid fabrication object).

In addition, the liquid discharge apparatus is not limited to an apparatus that discharges liquid to produce meaningful visible images such as texts and figures For example, an apparatus that forms a pattern or the like that does not have meaning itself, and an apparatus that models a three-dimensional image are also included.

The term "material to which liquid can adhere" represents a material which liquid can, at least temporarily, adhere to and solidify thereon, or a material into which liquid permeates. Examples of "material to which liquid can adhere" include paper sheets, recording media such as recording sheet, recording sheets, film, and cloth; electronic components such as electronic substrates and piezoelectric elements; and media such as powder layers, organ models, and testing cells. The term "material to which liquid can adhere" includes any material to which liquid adheres, unless particularly limited.

Examples of the "material to which liquid can adhere" include any materials on which liquid can be adhered even temporarily, such as paper, thread, fiber, fabric, leather, metal, plastic, glass, wood, and ceramic.

The terms "image formation", "recording", "printing", "image printing", and "fabricating" used herein can be used synonymously with each other.

The above-described embodiments are illustrative and do not limit the present disclosure. Thus, numerous additional modifications and variations are possible in light of the above teachings. For example, elements and/or features of different illustrative embodiments may be combined with each other and/or substituted for each other within the scope of the present disclosure.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

The invention claimed is:

1. An apparatus for discharging liquid, the apparatus comprising:

at least three heads configured to discharge liquid and arranged at positions shifted in a second direction intersecting with a first direction; and control circuitry configured to cause the at least three heads to scan in the first direction a number of times corresponding to an integral multiple of a number of the at least three heads to complete an image in a predetermined area;

wherein the control circuitry is configured to cause the at least three heads to scan in the first direction the number of times corresponding to the integral multiple of the number of the at least three heads to form dots in a plurality of predetermined areas including the predetermined area, wherein the plurality of predetermined areas is smaller in number than the number of times of scanning of the at least three heads.

2. The apparatus according to claim 1, wherein the number of times of scanning of the at least three heads in the predetermined area is the same for each of the at least three heads.

3. The apparatus according to claim 1, wherein a joint portion between adjacent two of the at least three heads is located at a boundary between the predetermined area and another predetermined area adjacent to the predetermined area in the second direction.

4. The apparatus according to claim 1, wherein a first scanning line of the predetermined area is completed in three scans of the at least three heads.

5. The apparatus according to claim 1, wherein the control circuitry is configured to cause the at least three heads to discharge liquid in a first scanning and a last scanning of the number of times of scanning of the at least three heads to complete the image in the predetermined area, and wherein dots of the predetermined area are formed by liquid discharged from one head of the at least three heads in the first scanning and liquid discharged from another head of the at least three heads in the last scanning.

6. The apparatus according to claim 1, wherein dots of the predetermined area are evenly assigned to the at least three heads.

7. A printing method for an apparatus including at least three heads configured to discharge liquid and arranged at positions shifted in a second direction intersecting with a first direction, the method comprising scanning the at least three heads in the first direction a number of times corresponding to an integral multiple of a number of the at least three heads to complete an image in a predetermined area;

wherein the scanning comprises scanning in the first direction the number of times corresponding to the integral multiple of the number of the at least three heads to form dots in a plurality of predetermined areas including the predetermined area, and wherein the plurality of predetermined areas is smaller in number than the number of times of scanning of the at least three heads.

8. The method according to claim 7, wherein the number of times of scanning of the at least three heads in the predetermined area is the same for each of the at least three heads.

9. The method according to claim 7, wherein a joint portion between adjacent two of the at least three heads is located at a boundary between the predetermined area and another predetermined area adjacent to the predetermined area in the second direction.

10. The method according to claim 7, wherein a first scanning line of the predetermined area is completed in three scans of the at least three heads.

11. The method according to claim 7, wherein the at least three heads discharge liquid in a first scanning and a last scanning of the number of times of scanning of the at least three heads to complete the image in the predetermined area, and wherein dots of the predetermined area are formed by liquid discharged from one head of the at least three heads in the first scanning and liquid discharged from another head of the at least three heads in the last scanning.

12. The method according to claim 7, wherein dots of the predetermined area are evenly assigned to the at least three heads.

13. An apparatus for discharging liquid, the apparatus comprising:

at least three heads configured to discharge liquid and arranged at positions shifted in a second direction intersecting with a first direction; and control circuitry configured to cause the at least three heads to scan in the first direction a number of times corresponding to an integral multiple of a number of the at least three heads to complete an image in a predetermined area;

wherein the control circuitry is configured to cause the at least three heads to discharge liquid in a first scanning and a last scanning of the number of times of scanning of the at least three heads to complete the image in the predetermined area;

wherein dots of the predetermined area are formed by liquid discharged from one head of the at least three heads in the first scanning and liquid discharged from another head of the at least three heads in the last scanning.

14. The apparatus according to claim 13, wherein the number of times of scanning of the at least three heads in the predetermined area is the same for each of the at least three heads.

15. The apparatus according to claim 13, wherein a joint portion between adjacent two of the at least three heads is located at a boundary between the predetermined area and another predetermined area adjacent to the predetermined area in the second direction.

16. The apparatus according to claim 13, wherein a first scanning line of the predetermined area is completed in three scans of the at least three heads.

17. The apparatus according to claim 13, wherein the at least three heads scan in the first direction the number of times corresponding to the integral multiple of the number of the at least three heads to form dots in a plurality of predetermined areas including the predetermined area, and wherein the plurality of predetermined areas is smaller in number than the number of times of scanning of the at least three heads.

18. The apparatus according to claim 13, wherein dots of the predetermined area are evenly assigned to the at least three heads.

* * * * *